US005377412A

United States Patent [19]

Schofield et al.

[11] Patent Number: 5,377,412

[45] Date of Patent: * Jan. 3, 1995

[54] SOFTOUCH SCISSORS

[75] Inventors: Robert T. Schofield, Madison; Craig H. Melter, Baraboo; Douglas J. Birkholz, De Forest, all of Wis.

[73] Assignee: Fiskars Oy Ab, Helsinki, Finland

[ * ] Notice: The portion of the term of this patent subsequent to Jan. 19, 2010 has been disclaimed.

[21] Appl. No.: 978,211

[22] Filed: Nov. 17, 1992

Related U.S. Application Data

[63] Continuation-in-part of Ser. No. 815,287, Dec. 27, 1991, Pat. No. 5,179,783.

[51] Int. Cl.[6] ..... B26B 13/16

[52] U.S. Cl. ..... 30/262; 30/254; 30/257

[58] Field of Search ..... 30/244, 254, 261, 193, 30/262

[56] References Cited

U.S. PATENT DOCUMENTS 154,637 9/1874 Breeden .
1,827,149 10/1931 Heimerdinger .
2,269,764 1/1942 Gutman .
3,775,846 12/1973 Johnson .
4,914,820 4/1990 Saito .
4,947,553 8/1990 Bendickson et al. .
4,980,975 1/1991 Hodson .
5,179,783 1/1993 Melter .

*Primary Examiner*—Richard K. Seidel
*Attorney, Agent, or Firm*—Foley & Lardner

[57] ABSTRACT

A soft touch scissors including a first or lower blade assembly having a handle and a blade having a tang molded in the handle and a second or upper handle assembly having a handle and a blade having a tang molded in the handle, the blade assemblies being pivotally connected, and biased by a spring to an open position, a rib on the top of the lower handle assembly and a rib on the bottom of the upper handle assembly located in a position to engage the rib on the lower handle assembly and a latch slidably mounted on the upper handle assembly for movement into engagement with the rib on the lower handle assembly to lock the handle assemblies in a closed position.

12 Claims, 4 Drawing Sheets

SOFTOUCH SCISSORS

CROSS-REFERENCE TO RELATED APPLICATION

This is a continuation-in-part application of U.S. Pat. application Ser. No. 07/815,287, filed on Dec. 27, 1991, having issued on Jan. 19, 1993, as U.S. Pat. No. 5,179,783.

FIELD OF THE INVENTION

The present invention relates to a soft touch hand grip type scissors and more particularly to a lock mechanism for holding the scissors in a closed position.

BACKGROUND OF THE INVENTION

Household scissors of the type set forth in the above-identified application included an internally mounted thumb-actuated button which is movable between open and closed positions with respect to one of the internal hooks. The scissors were locked in the closed position by squeezing the handles to move the end of the hook into the path of travel of the button. The button was then moved downward to engage the hook. However, the internal hooks could be damaged if the button was positioned in the closed position when the scissors were closed. The hook could also be damaged if the scissors were opened with the button latched to the hook.

SUMMARY OF THE PRESENT INVENTION

The scissors according to the present invention has been modified to avoid the problems noted above. In this regard the stops or ribs for limiting the opening motion of the handle assemblies are formed as an integral part of offset sections of the handle assemblies thus increasing the strength of the limit stops or rib.

In another aspect of the invention the actuating button is formed in a "U" shape having flanges on the inner surfaces of the side walls of the "U" which engage flanges provided on the outside of the limit stops or ribs. The side walls of the "U" shaped button being sufficiently flexible to release from the flanges on the ribs in the event the scissors are opened when locked.

In another aspect of the invention, the latch is mounted on a rib formed on the offset section of the upper handle assembly with a flange extending outwardly from each side of the rib. The latch is provided with a pair of tabs on the inside of the bight section of the "U" shaped latch which engage the flanges on the rib when moved to the operative or latched position. The side walls on latch being sufficiently flexible to allow the flanges on the ribs to snap into the legs if the scissors are closed with the latch in the down position.

Other principal features and advantages of the invention will become apparent to those skilled in the art upon review of the following drawings, the detailed description and the appended claims.

Figure 3:
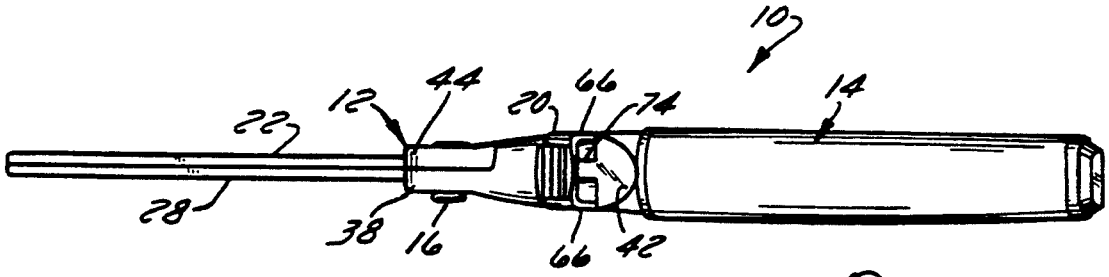
FIG. 3 is a top view of the scissors in the closed position with the button latch attached.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

As shown in the drawing the scissors 10 generally includes a first blade assembly 12 and a second blade assembly 14. The blade assemblies are pivotally connected by means of a thread forming screw 16. The blade assemblies are biased to an open position by means of a compression spring 18 and are locked in a closed position by means of a latch 20.

The first or bottom blade assembly 12 includes a blade 22 having a tang 24 molded into a handle 26. The second or top blade assembly 14 includes a blade 28 having a tang 30 molded into a handle 32. The bottom handle 26 includes a handle portion 34, an angularly offset section 36 and a blade mounting section 38. The top handle 32 includes a handle portion 40, an angularly offset section 42 and a blade mounting section 44.

Figure 2:
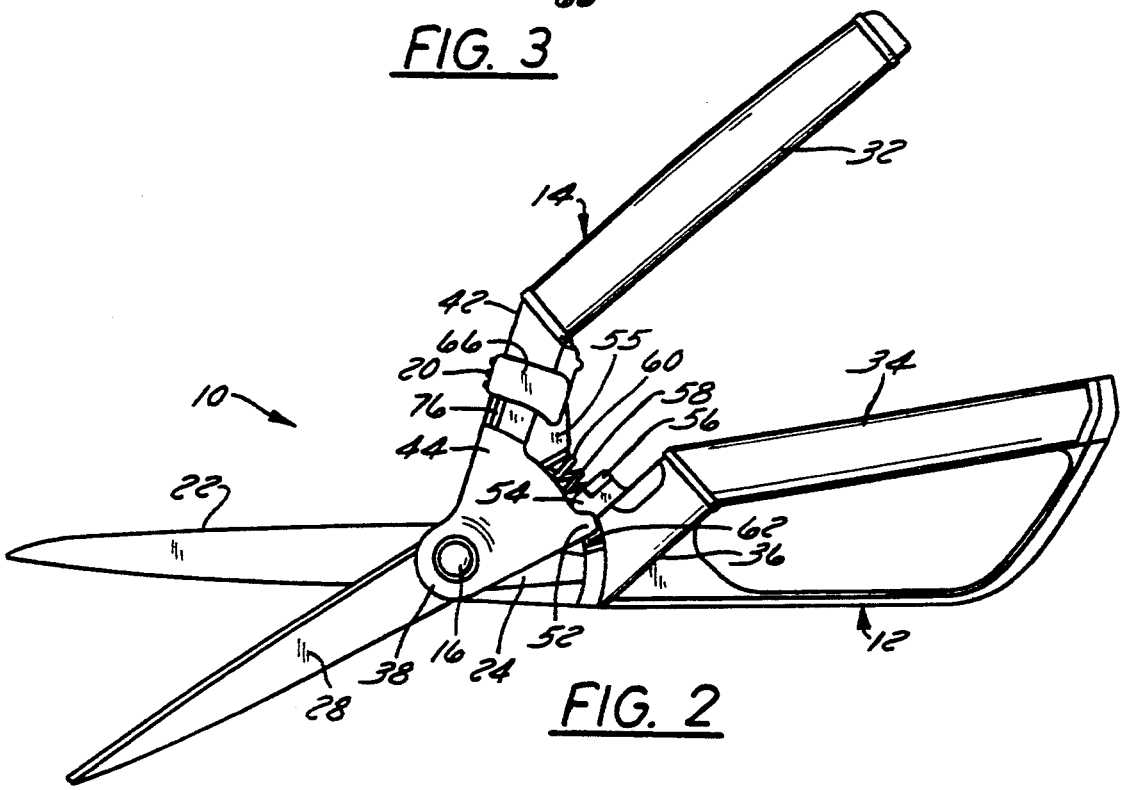
FIG. 2 is a side view of the soft touch scissors shown in the open position.
Figure 1:
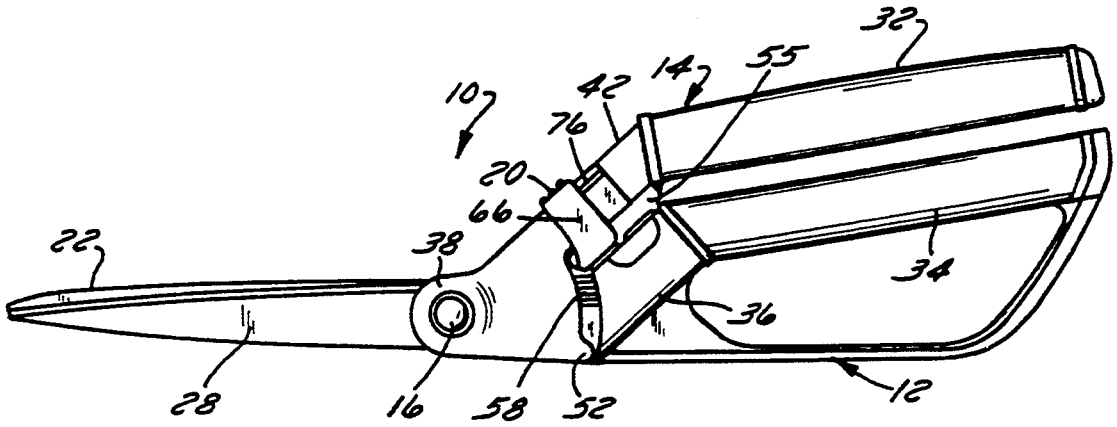
FIG. 1 is a side view of the all-purpose scissors according to the present invention shown in the closed position.
Figure 4A:
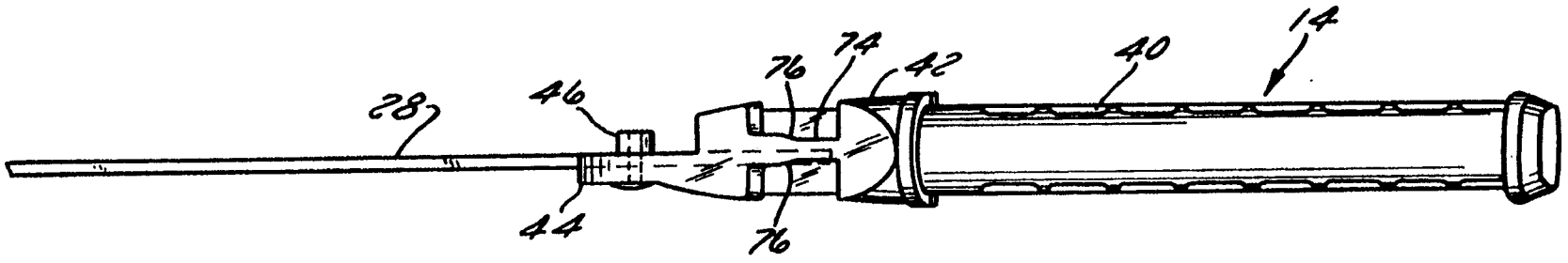
FIG. 4A is a top view of the top handle assembly.
Figure 4:
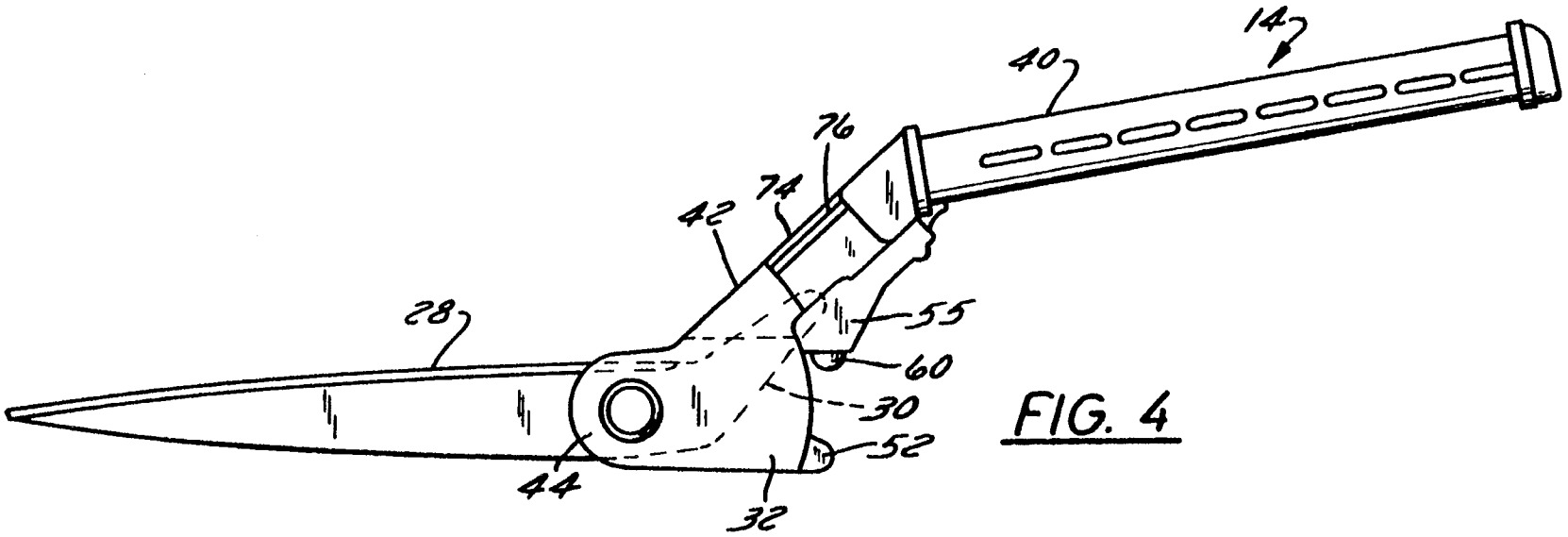
FIG. 4 is a side view of the top handle assembly.
Figure 5A:
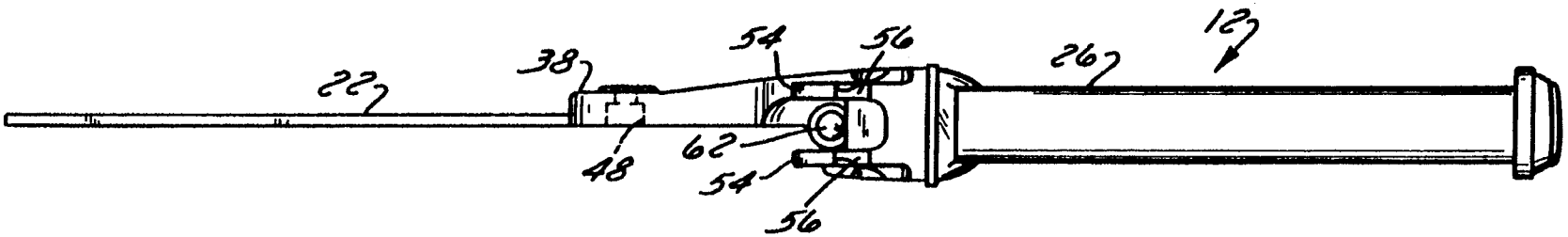
FIG. 5A is a top view of the bottom handle assembly.
Figure 5:
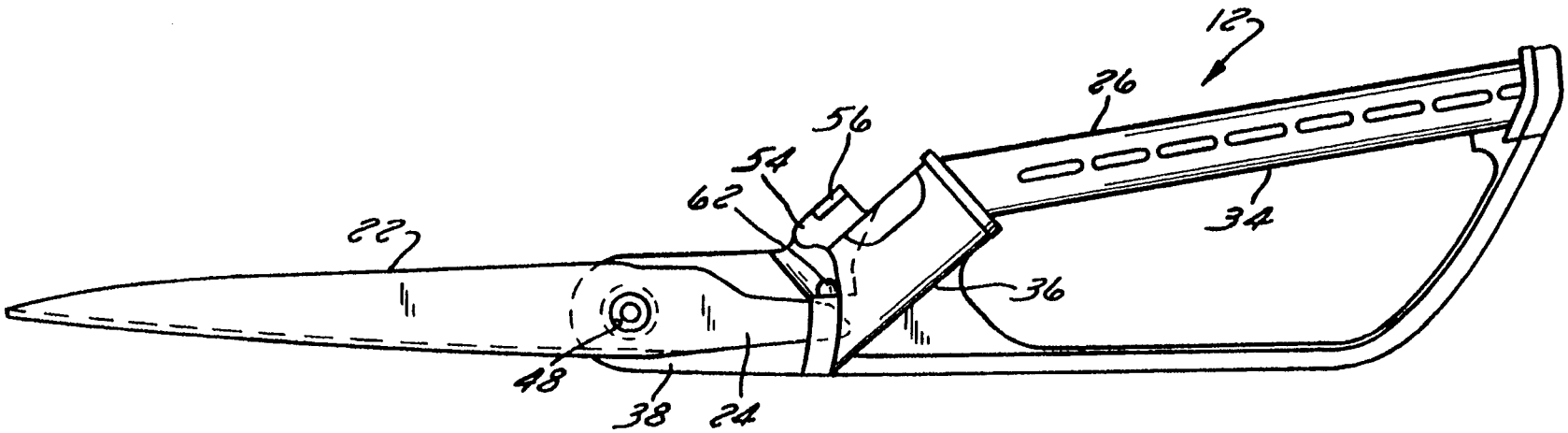
FIG. 5 is a side view of the bottom handle assembly.

Referring to FIGS. 4A and 5A a hub 46 is molded on the inside of section 44, FIG. 4A, which matingly engages a recess 48 in the mounting section 38 of the bottom handle 26, FIG. 5A. The handles 26 and 32 may be molded from a 45% fiberglass reinforced nylon material or other similar material and covered with a cushion material such as KRATON TM as shown in FIGS. 1 and 2. The blade assemblies 12 and 14 are pivotally connected by inserting the hub 48 on blade mounting section 44 into the recess 48 in the blade mounting section 38. The hub 48 is seated in the recess by the thread forming screw 16.

Means are provided for limiting the opening motion of the blade assemblies 12 and 14. Such means is in the form of a rib 52 provided on one side of the blade mounting section 44 of the top blade assembly 14. Ribs 54 are provided on the angularly offset section 36 of the bottom blade assembly 12, one of which lies in the path of motion of rib 52. A flange 56 is provided on the outside of each of the ribs 54.

The blade assemblies 12 and 14 are biased to an open position by means of the compression spring 18. In this regard, a button 60 is provided on the top offset section 42 on rib 55. A button 62 provided between the flanges 56 on the bottom offset section 36. The compression spring 58 is seated on the button 60 on the offset section 42 and the button 62 on the offset section 36.

Figure 7:
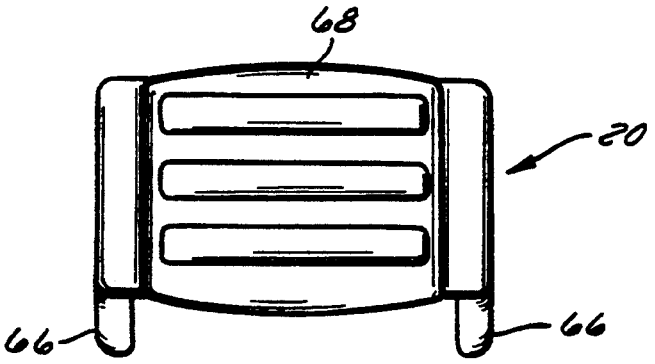
FIG. 7 is a top view of the button latch.
Figure 6:
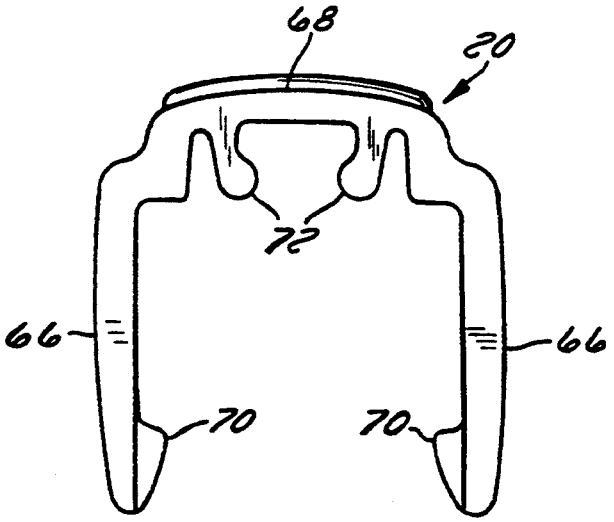
FIG. 6 is a front view of the button latch.
Figure 8:
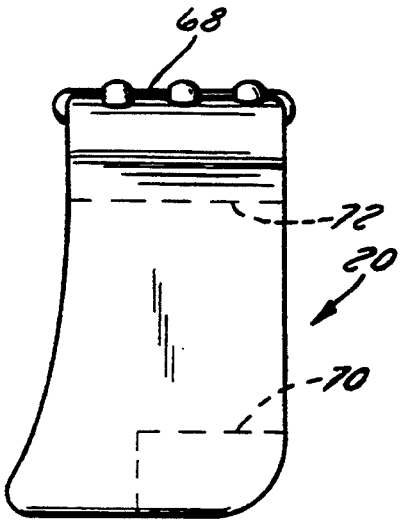
FIG. 8 is a side view of the button latch.

The blade assemblies 12 and 14 are locked in a closed position by means of the latch 20 which is mounted on the offset section 42 of the top blade assembly 14. In this regard, the offset section 42 includes a rib 74 along the top of the offset section 42. A flange 76 is provided on both sides of the lower end of the rib 74. The latch 20, FIGS. 6, 7 and 8, is in the form of a "U" having a pair of side walls 66 connected by a bight section 68. A flange 70 is provided on the inner ends of each of the side walls 66 and a pair of resilient tabs 72 are provided on the inside of the bight section 68. The latch is mounted on the offset section 42 by aligning the tabs 72 on either side of the rib 74. It should be noted that in the open position the button is pulled upward on the rib 74. When the scissors are closed, as shown in FIG. 1, the latch 66 is pushed downward or forward so that the tabs 72 slide under the flanges 76 on the rib 74 and the flanges 70 slide under the flanges 56 on the ribs 54 to lock the scissors in the closed position. With this arrangement the button can be quickly and easily moved upward on the offset section 42 to release the latch from the flanges 56 on the ribs 54.

Thus, it should be apparent that there has been provided in accordance with the present invention a soft touch scissors that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A soft touch scissors comprising:

a first blade assembly including a first handle and a first blade having a tang molded in the first handle, a second blade assembly including a second handle and a second blade having a tang molded in the second handle, means pivotally connecting said blade assemblies, said first handle including a rib on the top of said first handle and said second handle including a rib on the bottom of said second handle in a position to engage said rib on said first handle to limit the opening movement of said blade assemblies, a tab on said second rib and means on said second handle for engaging said tab on closing said blade assemblies to lock said blades in a closed position.

2. The scissors according to claim 1 including means for biasing said blades to an open position.

3. The scissors according to claim 2 including a spring seat on each of said handles and said biasing means comprising a compression spring mounted between spring seats.

4. The scissors according to claim 1 wherein said engaging means includes a U-shaped member having a pair of legs and a flange on the inside of each leg, said member is slidably mounted on said second handle for movement into and out of engagement with said tab.

5. A soft touch scissors comprising:

an upper blade assembly, a lower blade assembly pivotally connected to said upper blade assembly, each blade assembly including a handle having an offset section, and a blade connected to said offset section, means positioned between said offset sections for biasing said blades to an open position, means on each of said sections for limiting the opening motion of said assemblies, a latch mounted on the offset section of the upper handle assembly for movement between open and closed positions on said offset section, and a pair of flanges mounted on the offset section of the lower handle assembly, said latch being movable into engagement with said flanges to lock the blade assemblies in a closed position.

6. The scissors according to claim 5 wherein said latch comprises a U-shaped section having side walls connected by a bight section and a flange on the inside of each of said side walls, whereby said flanges on said side walls engage the flanges on the offset section of said lower blade assembly when the latch is moved to the closed position.

7. The scissors according to claim 6 wherein said offset section on said upper handle assembly includes a rib having a flange at the lower end and said latch includes a pair of resilient tabs which engage said flange when moved to the locked position.

8. A grip actuated scissors having a longitudinal axis, said scissors comprising:

a first blade assembly and a second blade assembly, each blade assembly including a cutting blade and a handle, each of said handles comprising an elongated handle portion connected to an angularly offset section such that both of said handles lie on the same side of said axis, each of said offset sections merging into blade mounting sections connecting said elongated handles to said blades;

a pivot assembly connecting said first blade assembly to said second blade assembly;

a compression spring mounted in said angularly offset sections for biasing said blades to an open position;

a catch arrangement on said offset sections for limiting the opening motion of said blade assemblies; and a latch mounted on one of said handles for engaging the other of said handles to lock the blades in a closed position.

9. The scissors according to claim 8 wherein each of said handle portions includes a number of openings on each side and a cushion molded on each of said handle portions for retaining said cushions on said handle portions.

10. The scissors according to claim 8 wherein upon closing of the scissors, said elongated handles are substantially parallel.

11. The scissors according to claim 10 wherein said angularly offset sections extend in substantially parallel directions when said scissors are in closed configuration.

12. The scissors according to claim 8 wherein said second handle has an enlarged finger loop extending from the distal end of said handle to the offset section.

* * * * *